United States Patent [19]

Wily

[11] 3,943,733

[45] Mar. 16, 1976

[54] METHOD AND APPARATUS FOR PRODUCING A KNITTED FABRIC INTERLACED WITH INSERT ELEMENTS

[75] Inventor: John L. Wily, Reading, Pa.

[73] Assignee: Rockwell International Corporation, Pittsburgh, Pa.

[22] Filed: Apr. 24, 1974

[21] Appl. No.: 463,538

[52] U.S. Cl. ..... 66/125 R; 66/9 R; 66/190

[51] Int. Cl.[2] ..... D04B 3/06

[58] Field of Search ..... 66/8, 9, 125, 131, 190, 66/20 L, 169, 170

[56] References Cited

UNITED STATES PATENTS

| | | | |
|---|---|---|---|
| 627,945 | 6/1899 | Waterfield | 66/190 |
| 2,165,975 | 7/1939 | Lawson et al. | 66/125 R |
| 2,174,544 | 10/1939 | Zieve | 66/125 R |
| 3,282,071 | 11/1966 | Marks et al. | 66/169 |
| 3,507,130 | 4/1970 | Marks et al. | 66/169 |
| 3,529,442 | 9/1970 | Gelber et al. | 66/131 |
| 3,832,867 | 9/1974 | Luchi | 66/17 |

FOREIGN PATENTS OR APPLICATIONS

| | | | |
|---|---|---|---|
| 450,156 | 7/1936 | United Kingdom | 66/9 R |
| 239,261 | 8/1925 | United Kingdom | 66/190 |
| 193,010 | 6/1962 | U.S.S.R. | 66/190 |
| 3,222 | 11/1897 | United Kingdom | |
| 1,033,564 | 6/1966 | United Kingdom | 66/125 |

OTHER PUBLICATIONS

Knitting International; "Saturnia: A New Textile Machine," Feb., 1974, pp. 54–57.

*Primary Examiner*—Ronald Feldbaum

[57] ABSTRACT

An improved circular weft knitting machine is of the type that directs warp insert elements inwardly and outwardly of the needle row in coordination with alternating interior and exterior knitting feed stations. The warp insert element is thereby woven to extend along the inside of the knitted fabric at an exteriorly feed knitting course and along the outside of the knitted fabric at an interiorly feed knitting course. The improvement includes a weft insert element feed station to locate a weft insert element between the inside surface of the knitted fabric and the outside surface of the warp insert elements. The weft insert element is supplied by a spool mounted outside of the needle row to a feed tube which discharges inside of the needle row at a point after an external knitting feed station and prior to the next interior knitting feed station.

8 Claims, 7 Drawing Figures

METHOD AND APPARATUS FOR PRODUCING A KNITTED FABRIC INTERLACED WITH INSERT ELEMENTS

BACKGROUND OF THE INVENTION

1. Field of the Invention

This invention relates to a circular weft knitting machine including means for providing warp insert elements between the wales of the knitted fabric and, more specifically, to such machine which has been improved to provide a weft insert element.

2. Description of the Invention

It has generally been recognized that an attractive feature of knitted fabric is that it may be produced on a knitting machine at a faster rate than woven fabric can be woven on a loom. However, knitted fabric usually requires more material and has a multi-directional stretch characteristic which is undesirable for some applications. In an effort to improve the desirability of the knitted fabric for some purposes, an interlacing of insert elements with the basic knitted fabric has heretofore been employed.

As explained in U.S. Pat. Nos. 3,507,130, and 3,621,677, the general weaving of warp insert elements with the circular weft knitted fabric provides a final fabric with some of the characteristics of woven fabric at the production speed of knitting. The insert elements may have a larger surface area than the knitted elements to reduce the total amount of material necessary for a given amount of fabric and may give the final fabric a non-stretch characteristic along its length. However, nothing is suggested by these prior art patents as means whereby circular weft knitting machines of this type might be further improved to provide a fabric having non-stretch characteristics along its width and an even more solid surface appearance than the warp inserts could alone provide.

When trying to privide machinery to produce an improved knitted fabric, it is also generally recognized in the knitting field as desirable to use exisitng machinery where possible. An added feature would be the ability to simply and inexpensively provide the improvement while maintaining the versatility of producing either the prior or improved fabric as customer needs may require.

SUMMARY OF THE INVENTION

It is therefore an object of the invention to provide an improved circular weft knitting machine capable of producing a fabric which resists lengthwise and widthwise stretching.

It is a further object to provide a knitting machine of the type described in which the resistance to stretching along the width of the fabric which it produces is provided by weft insert elements.

It is another object to provide a knitting machine of the type described wherein the means and method whereby the weft insert elements are included in the fabric do not require an extensive alteration of a basic knitting machine which has a warp insert capability or a recuction in the basic knitting rate.

It is still another object to provide a knitting machine of the type described in which the improvement for weft insert capabilities is inexpensive to provide for the machine and simple to install therein.

It is yet another object to provide an improved fabric capable of having a greater resistance to stretch along its width and of presenting more solid surface appearance than could be produced by a circular weft knitting machine limited to warp insert elements interlaced with the basic knitted fabric.

These and other objects of the invention are provided by preferred embodiments thereof which include an improved circular weft knitting machine of a type having warp insert elements feed between selected adjacent wales of the knitted fabric. The warp insert elements are directed inwardly and outwardly of the circumferential plane of the knitting needles during knitting which is consequentially supplied by alternating interior and exterior knitting feed stations. The warp insert elements are thereby located on the outside of the knitting course of connecting elements of loops originating from the interior knitting feed station and on the inside of the knitting course of connecting elements of loops originated from the exterior knitting feed station. The improvement comprises at least one weft insert element feed station mounted outside of the plane of the needles in a fixed relationship with the exterior knitting feed station to direct a weft insert element to extend along the inside surface of the basic knitted fabric between the inwardly directed warp insert elements and the basic knitted fabric so that directing the warp insert elements outwardly and forming the next knitting course originating from the interior knitting feed station secures the weft insert element between the warp insert elements and the basic knitting fabric.

DETAILED DESCRIPTION OF THE PREFERRED EMBODIMENTS

Figure 1:
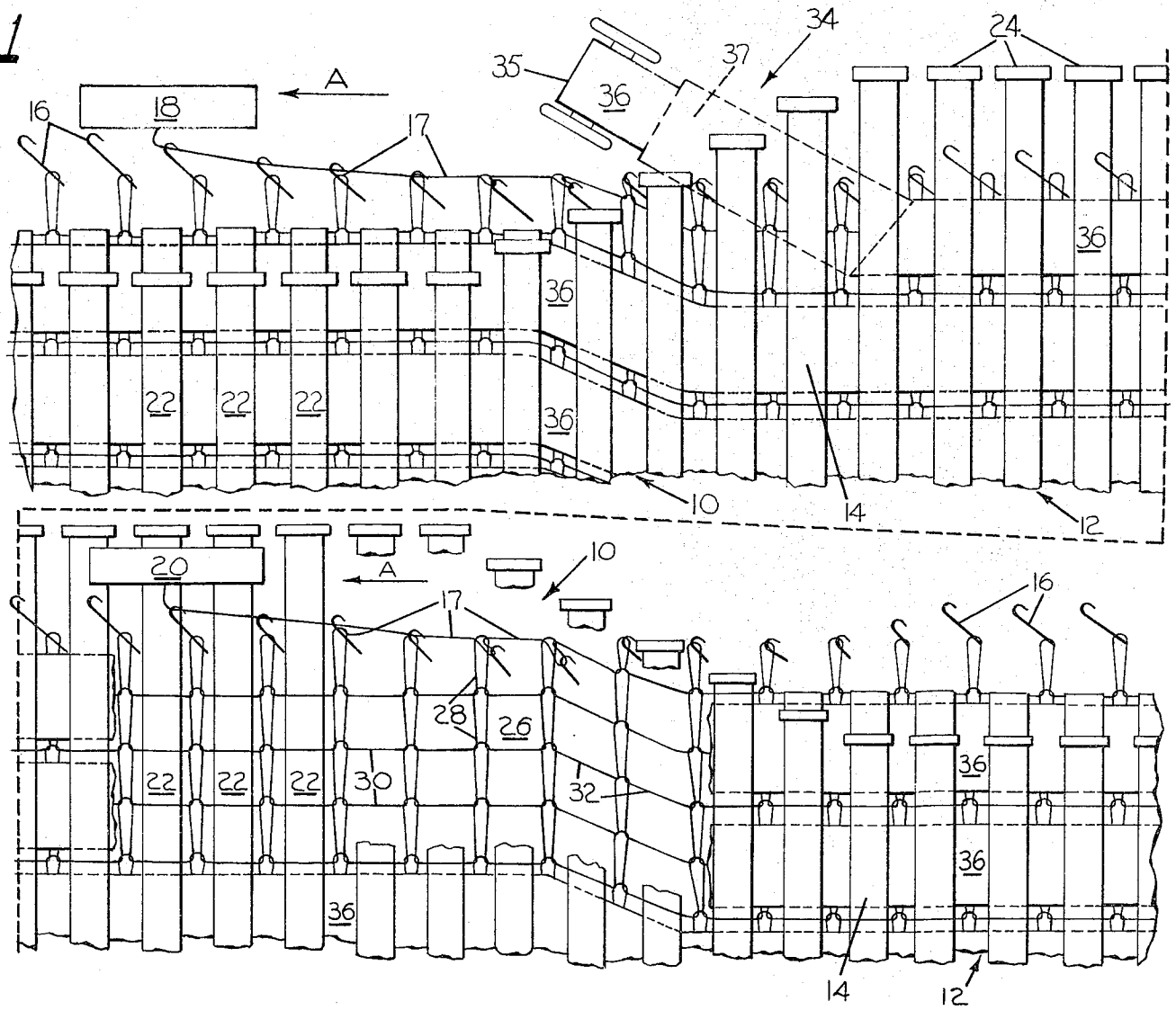
FIG. 1 is a schemmatic view of a section of the preferred fabric and knitting machine including various features of the inventions.

As seen in the schemmatic view of FIG. 1, the preferred weft knitting machine 10 produces the fabric 12. Only the Elements of the knitting machine 10 which are essential to an understanding of the invention are presented. U.S. Pat. Nos. 3,507,130 and 3,621,677 are two specific examples of the general type of knitting machine for which the present invention is an improvement and provide an adequate background for those skilled in the art to utilize the present disclosure to practice the invention.

FIG. 1 generally shows the inside surface 14 of the fabric 12 and a top view of the knitting plane 17 of the knitting machine 10 including the needles 16 in a straight row rather than the circular configuration that really exists. The knitting plane 17, for the purposes of this disclosure, is the horizontal plane in which the knitted fabric is supported at the needle array and might include sinkers if present. Sinkers have been omitted to simplify the drawings. Each needle 16 is tilted with respect to the knitting plane 17 since a top view would not reveal its position during knitting. Although existing circular weft knitting machines may have many knitting feed stations, only one exterior feed station 18 and one interior feed station 20 are included in FIG. 1 to adequately demonstrate the relationship of the invention with any feed station for the purposes of this disclosure.

A general requirement for circular weft knitting is that there be relative movement between the needles and the knitting feed stations. For example, in the second embodiment of U.S. Pat. No. 3,507,130, the needles move in a circular path past the fixed knitting feed stations. However, in the first embodiment of U.S. Pat. No. 3,507,130 and in U.S. Pat. No. 3,621,677, the knitting feed stations move in a circular path by a stationary circular array of needles. Regardless of which is moving or which is stationary the finished product by each means may be the same. Although the introduction of a plurality of warp insert elements between the needles has generally led to the use of a stationary needle array, either means may be employed to accomplish the required relative movement.

For the purpose of illustration, needles 16 and the fabric 12 are assumed to be stationary and the knitting feed stations 18 and 20 are shown in FIG. 1 to be moving in the direction indicated by the arrow A. As a result, the warp insert elements 22 remain aligned between adjacent stationary needles 16 but are capable of movement inwardly and outwardly of the row of needles 16 in a direction perpendicular thereto as the knitting feed stations move in the direction A. Their specific movement is accomplished by the use of a plurality of warp insert element guides 24 which move radially in direct cooperation with the circumferential movement of the knitting feed stations. The guides 24 cause the warp insert elements 22 to be inwardly of the needles 16 and the exterior feed station 18 and outwardly of the needles 16 and the interior feed station 20 as the respective stations 18, 20 pass thereby.

It can be seen that the basic knitted fabric, indicated at 26, includes wales of loops 28 extending in the warp direction and knitting courses 30 of loop connecting members 32 which extend in the weft direction. The knitting courses 30, and each associated loop 28, provided by an exterior knitting feed station 18 alternate with those provided by an interior knitting feed station 20.

The introduction of warp insert elements 22 by the prior art machines, as described hereinabove, results in the warp insert elements 22 being interwoven with the basic knitted fabric 26. Each element 22 is parallel with the wales of loops 28 and is positioned therebetween while being interwoven with the fabric 26 by the guides 24 to be located thereby on the inside of the fabric 26 at each knitting course 30 originating from an exterior knitting feed station 18 and on the outside of each course 30 originating from an interior knitting feed station 30.

To improve the basic knitted fabric 26 having the warp insert elements 22, a plurality of weft insert element feed stations 34 are provided to add weft insert elements 36 and, thereby, produce the preferred fabric 12. A detailed description of the weft insert element feed station 34, including a supply 35 and an insert guide tube 26, will be provided later.

To demonstrate the various features the invention provides, the fabric 12 has been selected as that which might be preferred for use in the production of disposable produce bags. The fabric 12 for this purpose should be produced quickly and inexpensively, resist stretching in all directions, and have a relatively solid surface to retain small articles. The overall integrity of the fabric 12 is provided by using nylon, or other high strength yarn, for the basic knitted fabric 26. The knit is loose and widely spaced by most standards but would, therefore, at a standard knitting rate, produce more yardage of fabric 12 with any given amount of yarn.

The warp insert elements 22 and the weft insert elements 36 are in strip form and made of plastic, paper, or some other material having a resistance to longitudinal stretch or failure. By coordinating the density of the basic knitted fabric 26 with the width of insert elements 22 and 36, fabric 12 may be given a substantially solid surface appearance. With a predetermined distance between adjacent needles 16 for a given machine 10, the warp insert elements 22 should be as wide as possible without interferring with the knitting process as they pass between the needles 16. The machine 10 should be set to form loops 28 slightly longer than half of the width of the weft insert elements 36. Consequently, the width of the elements 26 will substantially cover two loops 28 of each wale as it extends from a first course 30 originating from an interior knitting feed staton 20 to the next course 30 which also originates from an interior knitting feed station 20.

Figure 2:
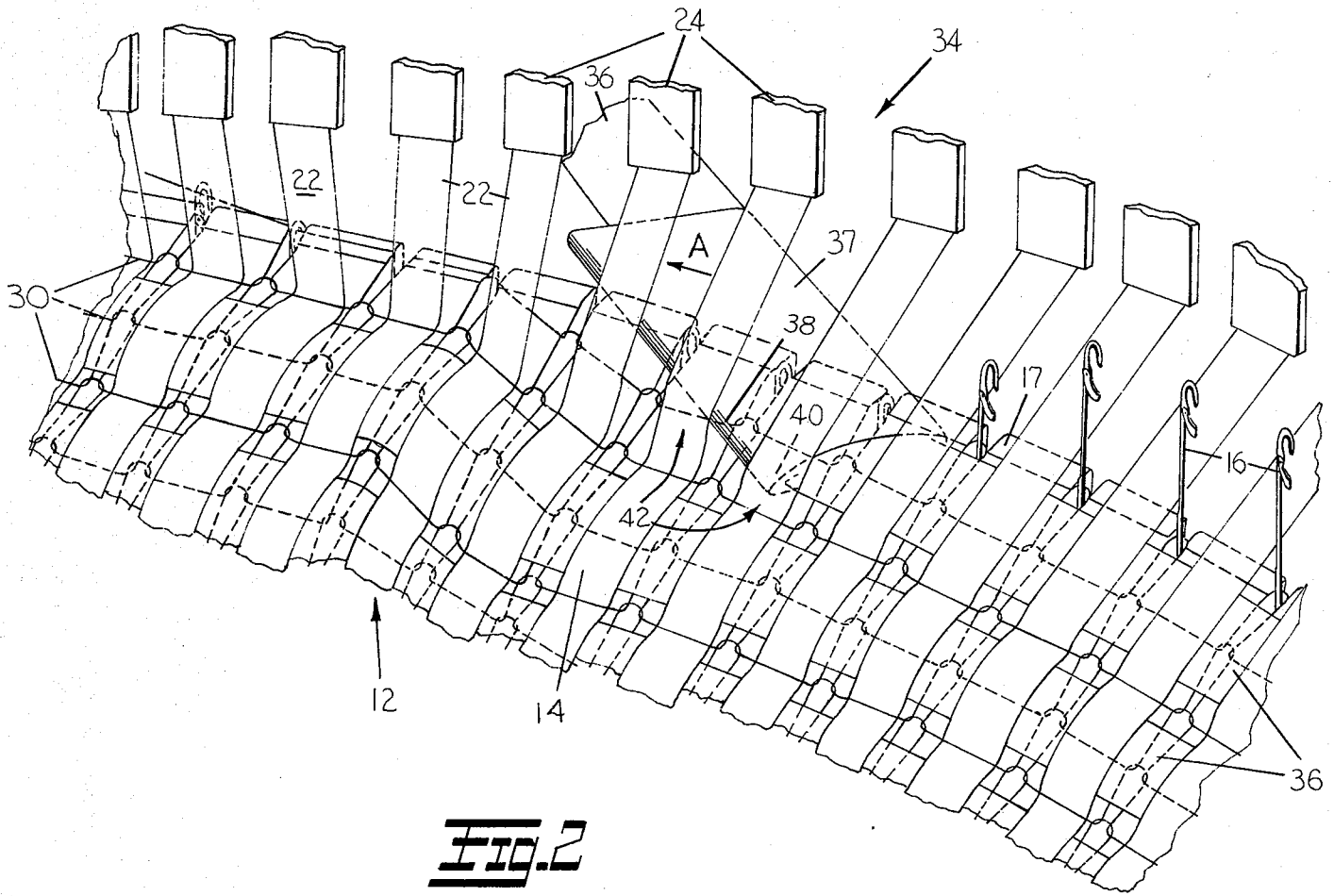
FIG. 2 is a fragmentary perspective view of the preferred knitting machine including the preferred weft insert element feed station.

IT is shown in FIG. 2, the preferred weft insert element feed station 34 includes an insert discharge tube 37 which directs the weft insert element 36 into position within the fabric 12 as it is drawn from a supply spool 35 (shown in FIG. 1). The supply spool 35 and the discharge tube 37 are mounted in a fixed relationship to each other and to the knitting feed stations 18, 20 so that they also move in a circular direction A about the stationary needles 16. The general configuration of the preferred tube 37 depends upon the width of the element 36, the distance between the knitting plane 17 and the lower portion of the warp insert element guides 24, and the general form the fabric 12 assumes as it depends from the knitting plane 17.

More specifically, the cross-sectional dimensions of the tube 37 throughout its length should generally correspond to the respective dimensions of the element 36 so that the element 36 may smoothly pass therethrough without being folded or wondering from its intended position with respect to the fabric 12. Since the tube 37 must direct the element 36 from outside the circumferential plane of the needles 16 to the inside, it is located above the knitting plane 17 at an area where the needles 16 are in a lowered position. Although shown in FIG. 2 in a relatively high position, the warp insert element guides 24 are in some machines quite close to the plane 17 to insure positive guiding of the elements 22 between the extended needles 16. It is therefor necessary to insure that the height and vertical location of the tube 37 will not interfere with the guides 24 or the plane 17 as the tube 37 passes thereby. Further, because the preferred tube 37 is intended for use with a relatively wide weft insert element 36, it is necessary to locate the element 36 at a point within the fabric 12 relatively remote from the needles 16. As the fabric is formed, it depends from the needles 16 to the central region of the machine. As a result, the inward edge 38 and corner 40 of the tube 37 are formed to extend below the plane 17 to conform to the natural contour the fabric 12 assumes after knitting. Providing the tube 37 with this form insures proper alignment of the element 36 with the fabric 12 and minimizes the interference with the warp insert elements 22 which the tube 37 might otherwise cause as it passes thereby.

During the knitting operation, the edge 38, which is intentionally smooth, slightly deflects the warp insert elements 22, as at 42. After the weft insert element 36 leaves the end of the tube 37, the next warp insert element 22 slips past the tube 37 to rest against the element 36. The normal movement of the guides 24 provides a direction to the warp element 22 which enable them to help hold the weft element 36 in position until the knitting of the next course 30. The temporary deflection by the tube 37 allows unrestricted positioning of the elements 36 followed by a stabilizing force from the warp elements 22 after being properly positioned. When the next course 30 is knit (not shown), the element 36 is secured between the basic knitted fabric 26 and the warp insert element 22 independent of the position of the guides 24.

Figure 3:
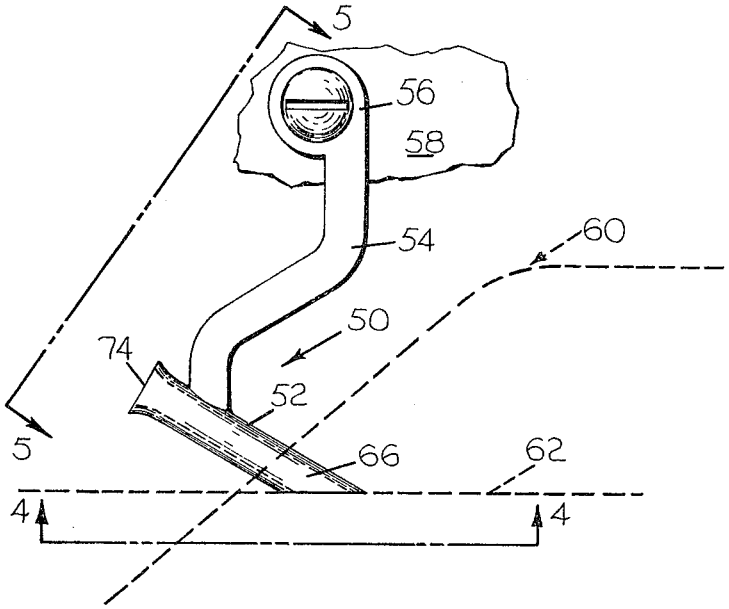
FIG. 3 is a plan view of an alternative embodiment of the invention.
Figure 4:
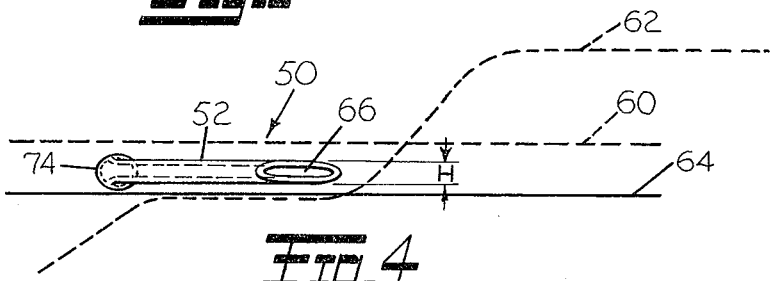
FIG. 4 is a view of the alternative embodiment as seen along line 4—4 of FIG. 3.
Figure 5:
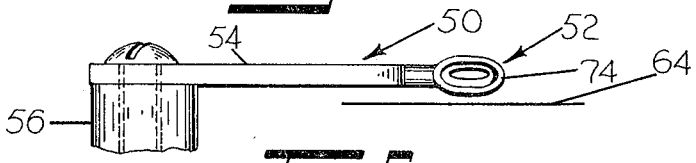
FIG. 5 is a view of the alternative embodiment as seen along line 5—5 of FIG. 3.

An alternative weft insert element discharge tube 50 is shown in FIGS. 3, 4 and 5 in an effort to further demonstrate the versatility of the present invention. The tube 50 includes a tubular portion 52 to receive and direct the insert element and a support structure 54. The structure 54 allows the portion 52 to be properly positioned as the tube 50 is secured to a port 56 which is part of the movable circular framing 58 of the machine for the feed stations. Included in the views are the path of the base of the warp insert element guides at 60, the path of the knitting needle at 62, and the knitting plane at 64.

Figure 6:
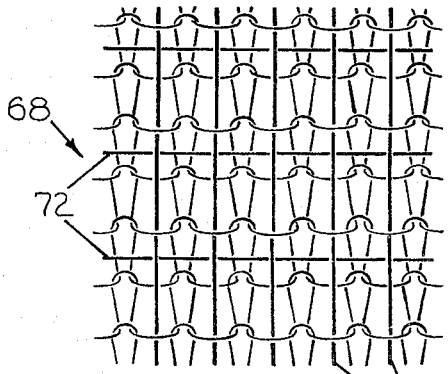
FIG. 6 is a view of fabric produced by use of the embodiment shown in FIG. 3.

The tube 50 is different from the embodiment shown hereinabove because the weft insert elements for which it is to be used are of narrow yarn for an application requiring resistance to stretch without the need for a solid surface appearance as was provided by the strip form. The discharge end 66 of the tubular portion 52 for this application need not extend down into the fabric as it is being formed since the yarn will not have to be evenly located between the two courses from adjacent interior knitting feed stations. As seen in FIG. 6, in a fabric 68 having narrower warp insert elements 70, the narrower weft insert elements 72 supplied by a tube 50 will tend to lie across the loops formed of yarn from an exterior feed station rather than extending to cover both loops as shown hereinabove. The same number of weft insert elements 72 can be provided for the fabric 68 and their location with respect to the fabric loops will not alter their ability to resist stretching. Discharging the yarn just interiorly of the extended needles results in the needles working with the warp insert elements to maintain the weft insert elements in position until they are secured in the fabric by the formation of the next course.

Although the receiving end 74 of the tubular portion 52 is flared to minimize resistance for the yarn passing therethrough, it can be seen that the general height H of the tubular portion 52 is kept at a minimum. It has been found that a height H of ⅛ inch provided adequate clearance for the tube 50 when used on a machine where the path 60 of the warp insert element guides passed relatively close to the knitting plane 64. Although in the tube 50 the support structure 54 has the same narrow, aligned configuration as the tubular portion 52, the actual shape of the structure 54, whether it extends below or above the plane 64, is unimportant if clearance is provided.

Figure 7:
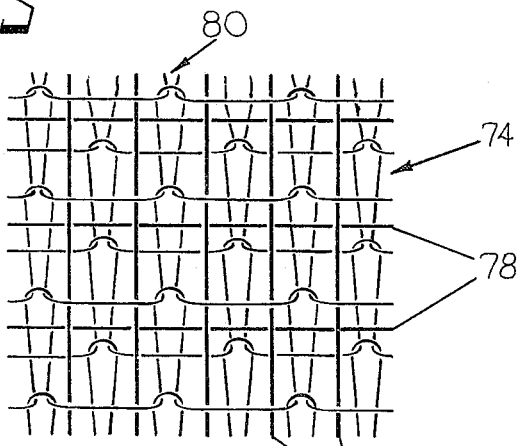
FIG. 7 is a view of an alternative fabric produced by use of the embodiment shown in FIG. 3.

As shown in FIG. 7, a fabric 74 is similar to fabric 68 of FIG. 6 with regard to its warp insert elements 76 and weft insert elements 78. It can be seen, however, that the knitting loop configuration 80 is different from that of fabric 68. The loop configuration 80 is only shown as an example of changes that may be made in the knitting pattern without altering the weft inserting means or its function as described hereinabove. Therefore, an alteration to the knitted fabric of FIGS. 1, 2 and 6, which might be accomplished by simple needle pattern changes, may still be referred to as a basic knitted fabric to be within the scope of the appended claims without departing from the spirit of the invention.

What is claimed is:

1. An improved circular weft knitting machine of the type which feeds warp insert elements between selected adjacent wales of a basic knitted fabric; wherein said improvement comprises:

means for directing said warp insert elements inwardly and outwardly of the circumferential plane of the knitting needles during knitting of said knitted fabric which is consequently supplied by alternating interior and exterior knitting feed stations to locate each said warp insert on the outside of a knitting course of connecting elements of loops originating from said exterior feed stations;

at least one weft insert element feed station mounted outside of said plane of said needles in a circumferentially and radially fixed disposition with respect to said exterior knitting feed stations to directly feed a weft insert element inwardly of said plane of said needles to cause said weft insert element to extend along the inside surface of said knitted fabric between said warp insert elements and said knitted fabric, whereby, said directing of said warp insert elements outside of said plane of said needles and forming the next said knitting course originating from said interior knitting feed stations secures said weft insert element between said warp insert elements and said knitted fabric.

2. The improved knitting machine as set forth in claim 1, wherein said weft insert element feed station comprises:

means circumferentially located between one of said exterior knitting feed statons and an adjacent one of said interior knitting feed stations and in a fixed radial position with respect to said plane of said needles for directly guiding said weft insert element from outside of said plane of said needles to a point of discharge inside of said plane of said needles and outside of said inwardly directed warp insert elements; and means mounted outside of said plane of said needles for supplying said weft insert element to said means for guiding of said weft insert element.

3. the improved knitting machine as set forth in claim 2, wherein said means for guiding said weft insert element includes a tubular member, said tubular member having an opening therethrough with a cross-section having dimensions greater than the corresponding dimensions of said weft insert element passing therethrough, said tubular member having a portion thereof located in said plane of said needles and having predetermined outside dimension which prevent it from interferring with the relative movement thereby of said needles and the means for directing said warp insert elements inwardly and outwardly of said plane of said needles.

4. The improved knitting machine as set forth in claim 3, wherein said tubular member includes a smooth camming surface for deflecting said warp insert elements being directed outwardly of said plane of said needles from the path of said member to prevent said warp insert elements from interferring with said weft insert element as it is being directed toward said inside surface of said knitted fabric.

5. The improved knitting machine as set forth in claim 3, wherein said weft insert element is a flat strip having a surface which is substantially greater than that of the yarn of said knitted fabric and said tubular member includes a discharge end that extends inwardly of said plane of said needles and is generally aligned with and closely adjacent to said inside surface of said knitted fabric depending from said needles.

6. The improved knitting machine as set forth in claim 5, wherein said tubular member includes a smooth camming surface for deflecting said warp insert elements being directed outwardly of said plane of said needles from the path of said member to prevent said warp insert elements from interferring with said weft insert element as it is being directed toward said inside surface of said knitted fabric.

7. A circular weft knitting machine comprising:

A circular array of needles;

a plurality of pairs of knitting feed stations disposed about said array of needles with relative circular movement therebetween during knitting of a basic knitted fabric;

means for guiding warp insert elements between selected adjacent wales of said basic knitted fabric and for directing said warp insert elements inwardly and outwardly of said array of needles and said feed stations so that first and second knitting feed stations of each of said pairs of knitting feed stations are respectively interior and exterior of said warp insert elements; and at least one weft insert element feed station mounted outside of said array of said knitting needles in a circumferentially and radially fixed disposition with respect to each of said pairs of knitting feed stations to directly feed a weft insert element inwardly of said plane of said needles to cause said weft insert element to extend along the inside surface of said basic knitted fabric inwardly of said needles which are raised for said knitting at said first knitting feed station, whereby, said directing of said warp insert elements outside of said array of said knitting needles forming the next knitting course originating from said first knitting feed station interior of said warp insert elements secures said weft insert element between said warp insert elements and said basic knitted fabric.

8. A method of producing a fabric on a circular weft knitting machine having an array of knitting needles and a plurality of adjacent pairs of knitting feed stations with relative circular movement therebetween, said method comprising:

feeding yarn from each one of said knitting feed stations for engagement by said knitting needles;

knitting a basic knitting fabric;

guiding warp insert elements between selected adjacent wales of said basic knitted fabric;

directing said warp insert elements inwardly and outwardly of said array of said knitting needles during said knitting so that first of said adjacent pairs of said knitting feed stations is outwardly of said warp insert elements and a second of said adjacent pairs of said knitting feed stations is inwardly of said warp insert elements; and directly feeding a weft insert element from a fixed location circumferentially between said first and second knitting feed stations and radially outside of said array of said knitting needles to an interior surface of said basic knitted fabric inside of said knitting needles and depending inwardly therefrom to the interior of said knitting machine;

securing said weft insert element between said warp insert element and said interior surface of said basic knitted fabric by said knitting at said second knitting feed station after said feeding of said weft insert element.

* * * * *